US010388200B2

(12) United States Patent
Moon et al.

(10) Patent No.: US 10,388,200 B2
(45) Date of Patent: Aug. 20, 2019

(54) DISPLAY DEVICE UTILIZING A DEGRADATION SENSOR AND METHOD OF DRIVING THE SAME

(71) Applicant: SAMSUNG DISPLAY CO., LTD., Yongin-si, Gyeonggi-do (KR)

(72) Inventors: Seung-Hyun Moon, Hwaseong-si (KR); Hee-Chul Hwang, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 206 days.

(21) Appl. No.: 15/067,964

(22) Filed: Mar. 11, 2016

(65) Prior Publication Data

US 2017/0069238 A1 Mar. 9, 2017

(30) Foreign Application Priority Data

Sep. 8, 2015 (KR) ..... 10-2015-0126904

(51) Int. Cl.

| | |
|---|---|
| ***G09G 3/30*** | (2006.01) |
| ***G09G 3/00*** | (2006.01) |
| *G09G 3/10* | (2006.01) |
| *G09G 3/3233* | (2016.01) |

(52) U.S. Cl.

CPC ..... *G09G 3/006* (2013.01); *G09G 3/007* (2013.01); *G09G 3/3233* (2013.01); *G09G 2300/0439* (2013.01); *G09G 2320/029* (2013.01); *G09G 2320/043* (2013.01); *G09G 2360/16* (2013.01)

(58) Field of Classification Search

CPC ..... G09G 3/3233; G09G 3/006; G09G 3/007

USPC ..... 345/76; 315/169.3

See application file for complete search history.

(56) References Cited

U.S. PATENT DOCUMENTS

| | | | | |
|---|---|---|---|---|
| 2003/0057895 | A1* | 3/2003 | Kimura | G09G 3/3233 315/169.2 |
| 2005/0052350 | A1* | 3/2005 | Mizukoshi | G09G 3/3233 345/55 |
| 2005/0110786 | A1* | 5/2005 | Inoue | G09G 3/3225 345/210 |
| 2005/0195178 | A1* | 9/2005 | Jo | G09G 3/3233 345/204 |
| 2007/0290947 | A1* | 12/2007 | Cok | G09G 3/3225 345/45 |
| 2008/0036703 | A1* | 2/2008 | Wang | G09G 3/3225 345/76 |
| 2010/0103083 | A1* | 4/2010 | Shin | G09G 3/3208 345/76 |
| 2010/0149226 | A1* | 6/2010 | Byun | G09G 3/3225 345/77 |
| 2011/0191042 | A1* | 8/2011 | Chaji | G09G 3/32 702/64 |

(Continued)

FOREIGN PATENT DOCUMENTS

KR 10-2012-0027975 A 3/2012

*Primary Examiner* — Adam J Snyder

(74) *Attorney, Agent, or Firm* — Lewis Roca Rothgerber Christie LLP

(57) ABSTRACT

A display device includes a display panel including a pixel block that includes pixels, a degradation sensor for measuring degradation information of the pixel block, and a degradation calculator for accumulating input data provided to each of the pixels and for calculating pixel degradation data of each of the pixels based on accumulated input data and the degradation information.

18 Claims, 8 Drawing Sheets

(56) References Cited

U.S. PATENT DOCUMENTS

| | | | | |
|---|---|---|---|---|
| 2014/0055500 | A1* | 2/2014 | Lai | G09G 3/3208 345/77 |
| 2016/0086548 | A1* | 3/2016 | Maeyama | G09G 3/3258 345/690 |

* cited by examiner

DISPLAY DEVICE UTILIZING A DEGRADATION SENSOR AND METHOD OF DRIVING THE SAME

CROSS-REFERENCE TO RELATED APPLICATION(S)

This application claims priority to and the benefit of Korean Patent Application No. 10-2015-0126904, filed on Sep. 8, 2015 in the Korean Intellectual Property Office (KIPO), the content of which is incorporated herein in its entirety by reference.

BACKGROUND

1. Technical Field

Aspects of the inventive concept relate to a display device and a method of driving the display device.

2. Description of the Related Art

An organic light emitting display device displays an image using organic light emitting diodes. An organic light emitting diode of the display device and a driving transistor that transfers a current to the organic light emitting diode may be degraded over time as the organic light emitting diode and the driving transistor operate.

A conventional organic light emitting display device generates sensing data by measuring a current that flows through each of the pixels in response to a certain grayscale value and compensates degradation (e.g., degradation of each of the pixels) based on the sensing data. However, a signal-to-noise ratio (SNR) of the sensing data in a low gray level region may be relatively low because the current flowing through each of the pixels is relatively small (i.e., reliability of the sensing data in the low gray level region may be relatively low). To improve the reliability of the sensing data in the low gray level region, the conventional organic light emitting display device defines a pixel block including some pixels and generates the sensing data by measuring a current of the pixel block. However, a spatial resolution (or an accuracy of spatial information) of the sensing data may decrease in reverse proportion to the number of pixels included in the pixel block.

SUMMARY

Aspects of some example embodiments of the present inventive concept are directed to a display device capable of improving (e.g., increasing) an accuracy of sensing data and a spatial resolution of the sensing data.

Aspects of some example embodiments of the present inventive concept are directed to a method of driving the display device.

According to some example embodiments of the present inventive concept, there is provided a display device may include a display panel including a pixel block that includes pixels, a degradation sensor for measuring degradation information of the pixel block, and a degradation calculator for accumulating input data provided to each of the pixels and for calculating pixel degradation data of each of the pixels based on accumulated input data and the degradation information.

In example embodiments, the degradation sensor may measure a current returned from the pixel block in response to a reference data signal provided to the pixels.

In example embodiments, the degradation calculator may calculate predicted pixel degradation data of each of the pixels based on the accumulated input data, may calculate measured block degradation data of the pixel block based on the degradation information, and may calculate the pixel degradation data of each of the pixels based on the predicted pixel degradation data and the measured block degradation data.

In example embodiments, the degradation calculator may include a degradation predictor for accumulating the input data provided to each of the pixels, for calculating predicted pixel degradation data of each of the pixels based on the accumulated input data, and for calculating predicted block degradation data of the pixel block based on the predicted pixel degradation data, a block degradation calculator for calculating measured block degradation data of the pixel block based on the degradation information, and a pixel degradation calculator for analyzing a correlation between the measured block degradation data and the predicted block degradation data and for calculating the pixel degradation data of each of the pixels based on the correlation.

In example embodiments, the degradation predictor may calculate the predicted pixel degradation data using a stress profile that represents a relation between the accumulated input data and a pixel degradation rate of each of the pixels.

In example embodiments, the degradation predictor may calculate the predicted block degradation data using an arithmetic mean of the predicted pixel degradation data.

In example embodiments, the pixel degradation calculator may derive a linear equation of a data distribution map that represents the correlation.

In example embodiments, the pixel degradation calculator may calculate a first coefficient and a first constant that satisfy Equation 1 below:

$$\min \Sigma_i \Sigma_j (\Delta Ibs_B(x+i,y+j) - a*\Delta Isp_B(x+i,y+j) - b)^2, \quad \text{[Equation 1]}$$

where ΔIbs_B(x, y) denotes the measured block degradation data pertaining to coordinates (x, y), ΔIsp_B(x, y) denotes the predicted block degradation data pertaining to coordinates (x, y), i denotes an integer, j denotes an integer, a denotes the first coefficient, and b denotes the first constant.

In example embodiments, the pixel degradation calculator may calculate the pixel degradation data based on the predicted pixel degradation data, the first coefficient, and the first constant.

In example embodiments, the pixel degradation calculator may calculate the pixel degradation data based on Equation 2 below:

$$\Delta Ibs_P(x,y) = a*\Delta Isp_P(x,y) + b, \quad \text{[Equation 2]}$$

where ΔIbs_P(x, y) denotes the pixel degradation data of a pixel pertaining to coordinates (x, y), ΔIsp_P(x, y) denotes the predicted pixel degradation data of the pixel pertaining to coordinates (x, y), a denotes the first coefficient, and b denotes the first constant.

In example embodiments, the pixel degradation calculator may calculate coefficients and a first constant that satisfy Equation 3 below:

$$\min \Sigma_i \Sigma_j [\Delta Ibs_B(x+i,y+f) - b - \Sigma_k (a_k * (\Delta Isp_B(x+i,y+j))^k)]^2, \quad \text{[Equation 3]}$$

where ΔIbs_B(x, y) denotes the measured block degradation data pertaining to coordinates (x, y), ΔIsp_B(x, y) denotes the predicted block degradation data pertaining to coordinates (x, y), i denotes an integer, j denotes an integer, k denotes a positive integer, a_k denotes a (k)th coefficient, and b denotes the first constant.

In example embodiments, the pixel degradation calculator calculates the pixel degradation data based on Equation 4 below:

$$\Delta Ibs_P(x,y) = b + \Sigma_k (a_k * \Delta Isp_P(x,y)^k), \quad \text{[Equation 4]}$$

where ΔIbs_P(x, y) denotes the pixel degradation data of a pixel pertaining to coordinates (x, y), ΔIsp_P(x, y) denotes the predicted pixel degradation data of the pixel pertaining to coordinates (x, y), a_k denotes the (k)th coefficient, and b denotes the first constant.

In example embodiments, the display device may further include a timing controller for compensating second input data based on the pixel degradation data.

In example embodiments, the degradation calculator may calculates pixel degradation information of each of the pixels based on the accumulated input data and the degradation data and may calculate the pixel degradation data of each of the pixels based on the pixel degradation information.

In example embodiments, the degradation calculator may include a data calculator for calculating average accumulated input data of the pixel block based on the accumulated input data, a data analyzer for analyzing a second correlation between the degradation information and the average accumulated input data, and a degradation calculator for calculating the pixel degradation information of each of the pixels based on the second correlation and the accumulated input data.

According to example embodiments, a method of driving a display device that includes a pixel block that includes pixels, the method may include measuring degradation information of the pixel block, and calculating pixel degradation data based accumulated input data of each of the pixels, which is generated by accumulating input data provided to each of the pixels and the degradation information.

In example embodiments, calculating the pixel degradation data of each of the pixels may include calculating predicted pixel degradation data of each of the pixels based on the accumulated input data, calculating predicted block degradation data of the pixel block based on the predicted pixel degradation data, calculating measured block degradation data of the pixel block based on the measured degradation information, analyzing a correlation between the measured block degradation data and the predicted block degradation data, and calculating the pixel degradation data of each of the pixels based on the correlation.

In example embodiments, analyzing the correlation may include calculating a first coefficient and a first constant that satisfy Equation 1 below:

$$\min \Sigma_i E_j(\Delta Ibs_B(x+i,y+j)-a*\Delta Isp_B(x+i,y+j)-b)^2, \quad \text{[Equation 1]}$$

where ΔIbs_B(x, y) denotes the measured block degradation data pertaining to coordinates (x, y), ΔIsp_B(x, y) denotes the predicted block degradation data pertaining to coordinates (x, y), i denotes an integer, j denotes an integer, a denotes the first coefficient, and b denotes the first constant.

In example embodiments, calculating the pixel degradation data may include calculating the pixel degradation data based on the predicted pixel degradation data, the first coefficient, and the first constant.

In example embodiments, calculating the pixel degradation data may include calculating average accumulated input data of the pixel block based on the accumulated input data, analyzing a second correlation between the degradation information and the average accumulated input data, and calculating the pixel degradation information of each of the pixels based on the second correlation and the accumulated input data.

Therefore, a display device according to example embodiments may improve an accuracy of sensing data and a spatial resolution of the sensing data by recovering (or, restoring) the spatial resolution of the sensing data per unit pixel (i.e., for each pixel) based on accumulated input data generated by accumulating input data for each of the pixels. That is, the display device may improve an accuracy of degradation compensation.

In addition, a method of driving a display device according to example embodiments may drive the display device efficiently.

BRIEF DESCRIPTION OF THE DRAWINGS

Illustrative, non-limiting example embodiments will be more clearly understood from the following detailed description taken in conjunction with the accompanying drawings.

DESCRIPTION OF EMBODIMENTS

Hereinafter, the present inventive concept will be explained in detail with reference to the accompanying drawings.

Figure 1:
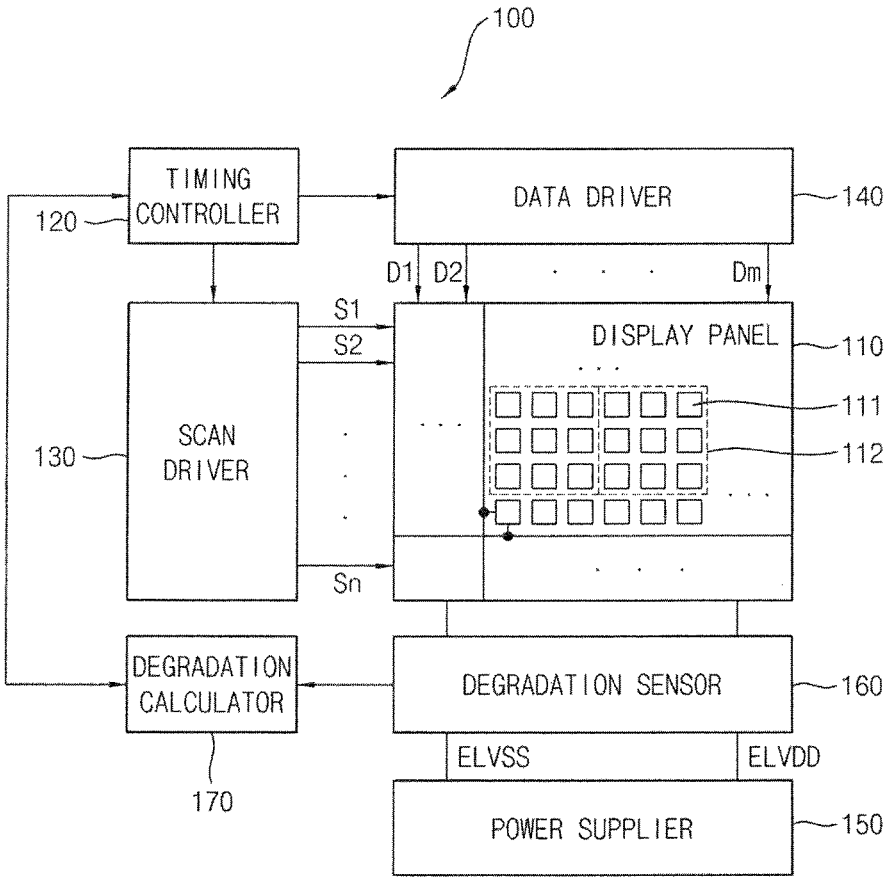
FIG. 1 is a block diagram illustrating a display device according to some example embodiments of the present inventive concept.

FIG. 1 is a block diagram illustrating a display device according to some example embodiments of the present inventive concept.

Referring to FIG. 1, the display device 100 may include a display panel 110, a timing controller 120, a scan driver 130, a data driver 140, a power supplier 150, a degradation sensor 160, and a degradation calculator 170. The display device 100 may display an image based on image data provided from the outside (e.g., an external component). For example, the display device 100 may be an organic light emitting display device.

The display panel 110 may include scan lines S1 through Sn, data lines D1 through Dm, and pixels 111 disposed in pixel regions, where each of n and m is an integer greater than or equal to 2. Here, the pixel regions may be at crossing regions of the scan lines S1 through Sn and the data lines D1 through Dm. Each of the pixels 111 may store a data signal in response to a scan signal and may emit light based on a stored data signal. Here, scan signals may be provided from the scan driver 130 to the pixels 111 through the scan lines S1 through Sn, and data signals may be provided from the data driver 140 to the pixels through the data lines D1 through Dm.

In some example embodiments, the display panel 110 may include one or more pixel blocks 112. The pixels 111 may be organized into the one or more pixel block 112. The pixel block 112 may include M×N (or, M×N number of) pixels, where each of M and N is a positive integer that satisfies M+N>2. For example, the pixel block 112 may include 3×3 pixels.

The timing controller 120 may control the scan driver 130, the data driver 140, the power supplier 150, the degradation sensor 160, and the degradation calculating unit (e.g., the degradation calculator) 170. For example, the timing controller 120 may generate a scan driving control signal, a data driving control signal, and a power control signal, and may control the scan driver 130, the data driver 140, and the power supplier 150 based on generated signals.

The scan driver 130 may generate the scan signals based on the scan driving control signal. The scan driving control signal may be provided from the timing controller 120 to the scan driver 130. Here, the scan driving control signal may include a start pulse and clock signals, and the scan driver 130 may include a shift register for sequentially generating the scan signals based on the start pulse and the clock signals.

The data driver 140 may generate the data signals based on the image data. The data driver 140 may provide generated data signals to the display panel 110 in response to the data driving control signal. Here, the data driving control signal may be provided from the timing controller 120 to the data driver 140.

The power supplier 150 may generate driving voltages to drive the display device 100. The driving voltages may include a first power voltage ELVDD and a second power voltage ELVSS. The first power voltage ELVDD may be greater than (i.e., at a higher voltage than) the second power voltage ELVSS.

The degradation sensor 160 may measure degradation information of the pixel block 112. In some example embodiments, the degradation sensor 160 may measure a current, which is returned (e.g., fed-back) from the pixel block 112 in response to a reference signal provided to the pixels 111. Here, the reference signal may be provided from the data driver 140 to the pixels 111 (or, the display panel 110) based on a certain grayscale value. The current (e.g., the fed-back current) may be a total sum of currents that flow through a driving transistors (or, organic light emitting diodes) of the pixels 111 included in the pixel block 112. A configuration of the degradation sensor 160 will be described in more detail with reference to FIG. 2.

The degradation calculator 170 may accumulate input data provided to the pixels 111 during certain times, and may calculate pixel degradation data of each of the pixels 111 based on the accumulated input data and the degradation information. Here, the degradation information may be provided from the degradation sensor 160 to the degradation calculator 170.

In some example embodiments, the degradation calculator 170 may calculate predicted pixel degradation data of each of the pixels 111 based on the accumulated input data, may calculate measured block degradation data of the pixel block 112 based on the degradation information (i.e., the degradation information of the pixel block 112), and may calculate pixel degradation data of each of the pixels 111 based on the predicted pixel degradation data and the measured block degradation data. That is, the degradation calculator 170 may recover (or restore) a spatial resolution (or a spatial accuracy) of the measured block degradation data per unit pixel (or for each pixel, on a pixel-by-pixel basis) based on the predicted pixel degradation data.

In some example embodiments, the degradation calculator 170 may calculate the pixel degradation information of each of the pixels based on the accumulated input data and the degradation information, and may calculate the pixel degradation data of each of the pixels 111 based on calculated pixel degradation information. That is, the degradation calculator 170 may recover (or restore) a spatial resolution (or a spatial accuracy) of the degradation information (i.e., the degradation information of the pixel block 112) per unit pixel (or for each pixel) based on the accumulated input data of each of the pixels 111.

In this case, the timing controller 120 may compensate the input data based on the pixel degradation data generated by the degradation calculator 170. The timing controller 120 may calculate degradation compensation data based on the pixel degradation data and may compensate the input data (e.g., a grayscale values) using the degradation compensation data.

While FIG. 1 illustrates the degradation calculator 170 as being included in the display device 100, the degradation calculator 170 is not limited thereto. For example, the degradation calculator 170 may be included in the timing controller 120, or a driving integrated circuit (e.g., the scan driver 130 and/or the data driver 140).

As described above, the display device 100 according to some example embodiments may recover (or restore) a spatial resolution of the sensing data of the pixel block 112 per unit pixel based on the accumulated input data, which is generated by accumulating the input data provided to each of the pixels 111. Therefore, the display device 100 may improve (e.g., increase) an accuracy of the sensing data and the spatial resolution of the sensing data. In addition, the display device 100 may improve (e.g., increase) an accuracy of degradation compensation because the display device 100 performs the degradation compensation based on the sensing data, which has an improved (e.g., increased) spatial resolution.

Figure 2:
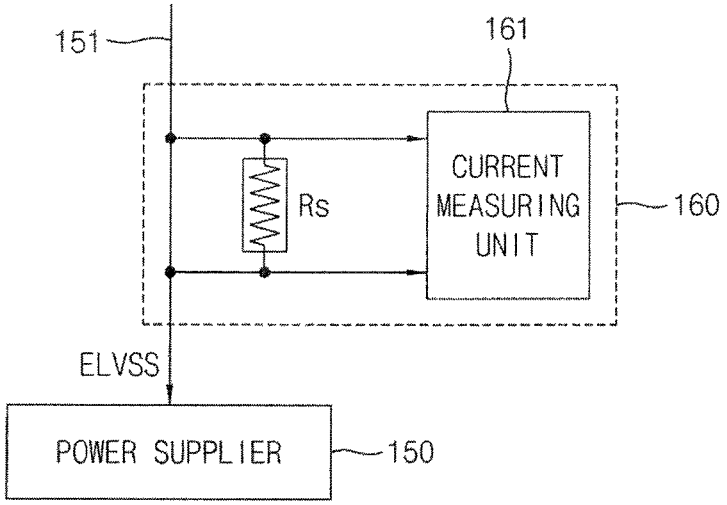
FIG. 2 is a block diagram illustrating an example of a degradation sensor included in the display device of FIG. 1.

FIG. 2 is a block diagram illustrating an example of a degradation sensor included in the display device of FIG. 1.

Referring to FIGS. 1 and 2, the degradation sensor 160 may include a resistor Rs and a current measuring unit 161. The resistor Rs may be electrically connected in parallel to a power supplying line 151 electrically connected to the pixel block 112. The current measuring unit 161 may measure a driving current based on a voltage (e.g., a voltage drop) across the resistor Rs. Here, the driving current may be a returned current (e.g., a fed-back current), which is returned from the display panel 110 to the degradation sensor 160. For example, the current measuring unit 161 may amplify the voltage across the resistor Rs and may output a measured current signal as an amplified voltage.

Figure 3:
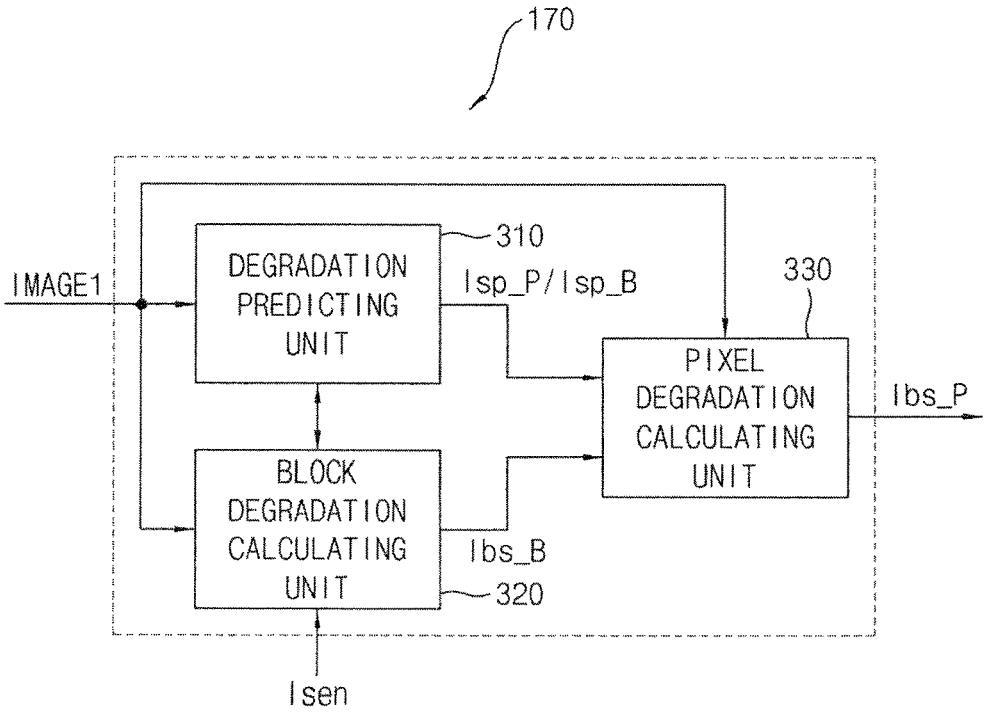
FIG. 3 is a block diagram illustrating an example of a degradation calculator included in the display device of FIG. 1.

FIG. 3 is a block diagram illustrating an example of a degradation calculator included in the display device of FIG. 1.

Referring to FIGS. 1 and 3, the degradation calculator 170 may include a degradation predicting unit (e.g., a degradation predictor) 310, a block degradation calculating unit (e.g., a block degradation calculator) 320, and a pixel degradation calculating unit (e.g., a pixel degradation calculator) 330.

The degradation predicting unit 310 may accumulate input data IMAGE1 provided to each of the pixels 111, and may calculate the predicted pixel degradation data Isp_P of each of the pixels 111 based on the accumulated input data. In addition, the degradation predicting unit 310 may calculate predicted block degradation data Isp_B of the pixel block 112 based on the predicted pixel degradation data Isp_P.

In an example embodiment, the degradation predicting unit 310 may accumulate the input data IMAGE1 provided to each of the pixels 111 with a certain accumulation period, and may store the accumulated input data to a memory device. The degradation predicting unit 310 may read the accumulated input data of the pixels 111 from the memory device, may accumulate the input data IMAGE1 as the accumulated input data, which is read, and may store the accumulated input data, which is an accumulation up to current time (e.g., a current frame), to the memory device. The accumulated input data stored in the memory device may not be initialized, and may be continuously accumulated during the time that the display device 100 is driven.

For example, the degradation predicting unit 310 may accumulate input data, which is provided from an initial driving time of the display device 100 to current time. For example, when the display device 100 is operated for 300 hours and the input data provided to a first pixel is kept with a grayscale value of 256 during the 300 hours, the degradation predicting unit 310 may accumulate the input data (i.e., the grayscale value of 256) for each frame, and may calculate first accumulated input data having identifying indices (256, 300). Here, the 300 index may be a driving time of the first pixel, and the 256 index may be average input data during the driving time. Similarly, when the display device 100 is operated for 300 hours and the input data provided to a second pixel is kept with a grayscale value of 200 for 300 hours, the degradation predicting unit 310 may calculate second accumulated input data having identifying indices (200, 300).

In an example embodiment, the degradation predicting unit 310 may calculate predicted pixel degradation data Isp_P using (or based on) a stress profile, which defines a pixel degradation rate corresponding to the accumulated input data (i.e., a stress profile, which represents a relation between the accumulated input data and a pixel degradation rate of each of the pixels). For example, when the first accumulated input data has identifying indices (256, 300), the degradation predicting unit 310 may calculate a first degradation rate (e.g., 50 percent (%)) of the first pixel based on the stress profile, and may calculate a current (i.e., the predicted pixel degradation data Isp_P) (e.g., 18 milliamperes (mA)×50 percent (%)=9 milliamperes (mA)) corresponding to a grayscale value of 256.

In an example embodiment, the degradation predicting unit 310 may calculate predicted block degradation data Isp_B based on the predicted pixel degradation data Isp_P. For example, when a first pixel block includes first through third pixels, and first through third predicted pixel degradation data of the first through third pixels are 9 milliamperes (mA), 9 milliamperes (mA), 0 milliamperes (mA), the degradation predicting unit 310 may calculate first predicted block degradation data having 6 milliamperes (mA) by calculating an arithmetic mean (or an arithmetic average) of the first through third pixel degradation data (i.e., (9+9+0)/3=6 milliamperes (mA)).

The block degradation calculating unit 320 may calculate the measured block degradation data Ibs_B of the pixel block 112 based on measured degradation information (i.e., the degradation information of the pixel block 112). For example, the degradation sensor 160 may measure a current of a first pixel block with 14 milliamperes (mA), and the block degradation calculating unit 320 may determine first measured block degradation data of the first pixel block as 14 milliamperes (mA).

The block degradation calculating unit 320 may generate the measured block degradation data Ibs_B having the same unit as that of the predicted block degradation data Isp_B (or the predicted pixel degradation data Isp_P) generated by the degradation predicting unit 310. For example, when first predicted block degradation data (e.g., first predicted pixel degradation data) is 50 percent (%) (i.e., a unit is a degradation rate of percent (%)), the block degradation calculating unit 320 may calculate first measured block degradation data having 77.7 percent (%) (i.e., 14/18×100=77.7 percent (%)) based on a measured current of a first pixel block having a 14 milliamperes (mA) and a reference current having 18 milliamperes (mA).

The pixel degradation calculating unit 330 may analyze a correlation between the measured block degradation data Ibs_B and the predicted block degradation data Isp_B, and may calculate the pixel degradation data Ibs_P of each of the pixels 111 based on the correlation.

A process of calculating the pixel degradation data Ibs_P by the pixel degradation calculating unit 330 will be described in more detail with reference to FIGS. 5A and 5B.

Figure 4A:
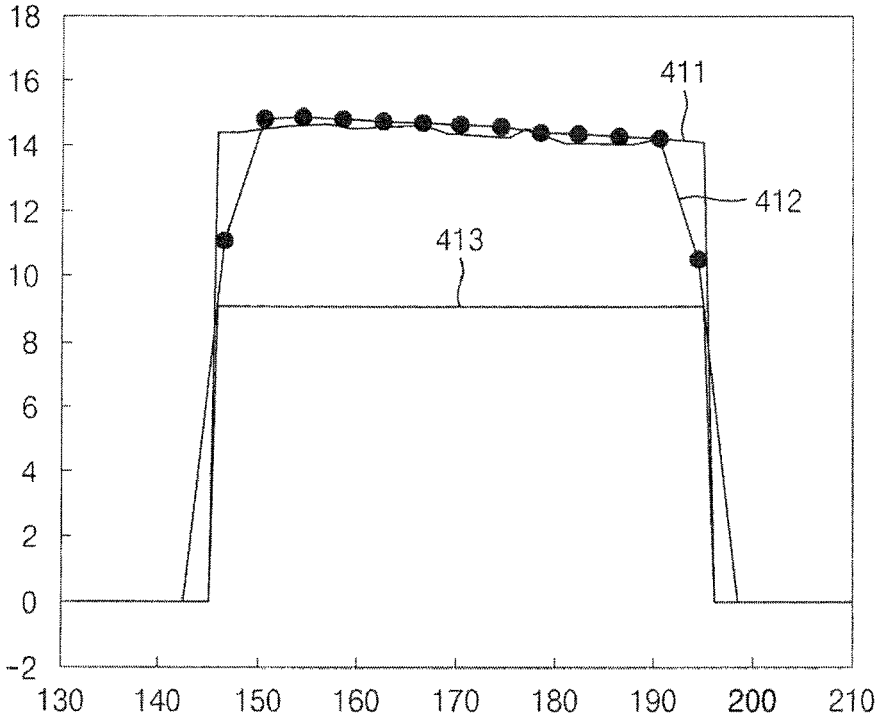
FIGS. 4A-4C are diagrams illustrating an example of the degradation data generated by the degradation calculator of FIG. 3.
Figure 4B:
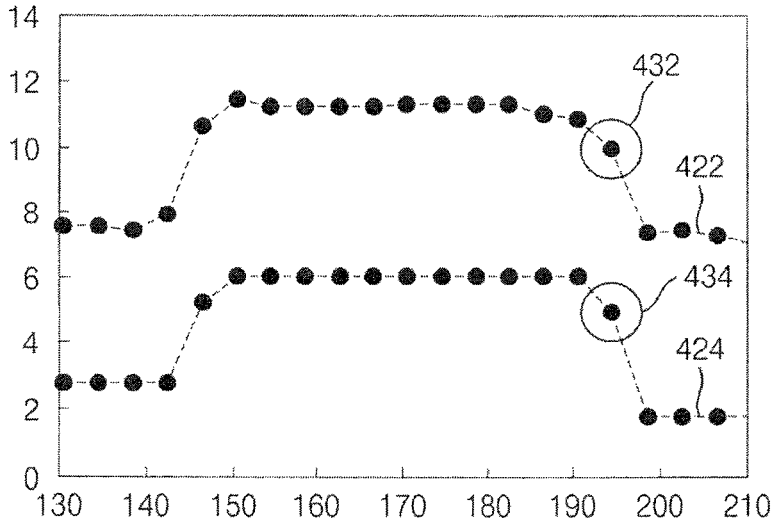
Figure 4C:
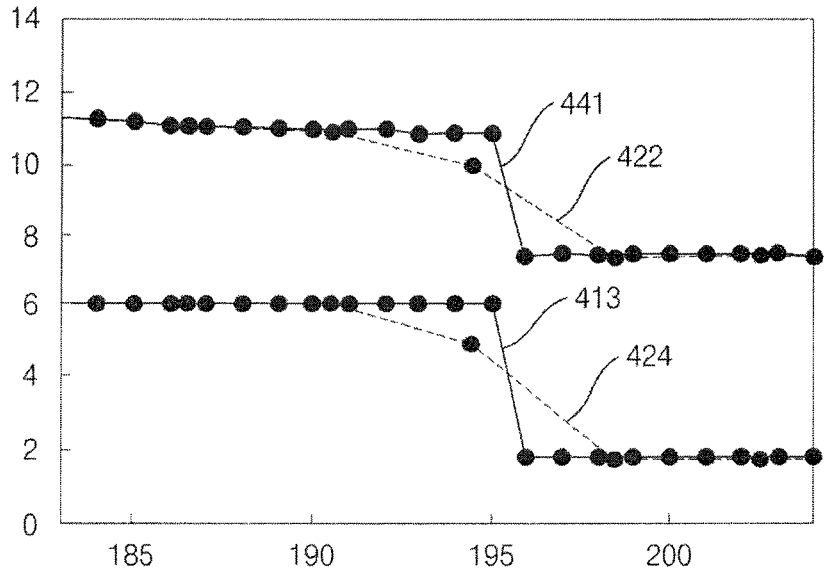

FIGS. 4A through 4C are diagrams illustrating an example of degradation data generated by the degradation calculator of FIG. 3.

Referring to FIG. 4A, real degradation data 411, measured block degradation data 412, and predicted pixel degradation data 413 are illustrated. The real degradation data 411 and the predicted pixel degradation data 413 may include degradation data (e.g., a current value) of each of the pixels 111 (e.g., a 130th pixel through a 210th pixel) arranged in the same pixel row. The measured block degradation data 412 may include degradation data (e.g., a current value) of each of the pixel blocks located in the same pixel row.

As illustrated in FIG. 4A, in a first region including a 120th pixel through a 145th pixel, the measured block degradation data 412 may include a value of 0 milliamperes (mA), and the predicted pixel degradation data 413 may include a value of 0 milliamperes (mA). In a second region including a 146th pixel through a 195th pixel, the measured block degradation data 412 may include a value in a range of about 14 milliamperes (mA) to about 15 milliamperes (mA), and the predicted pixel degradation data 413 may include a value of 9 milliamperes (mA). In a second region including a 196th pixel through a 210th pixel, the measured block degradation data 412 may include a value of 0 milliamperes (mA), and the predicted pixel degradation data 413 may include a value of 0 milliamperes (mA).

The measured block degradation data 412 may have a value that is substantially the same as, or similar to, a value of the real degradation data 411 in the first region through the third region. However, the measured block degradation data 412 may have a value that is different from a value of the real degradation data 412 in a first boundary between the first region and the second region and a second boundary between the second region and the third region. Because the measured block degradation data 412 illustrated in FIG. 4A may include measured currents (or an average of measured currents) of 4 pixels that are adjacent to each other, the measured block degradation data 412 may have a value of 11 milliamperes (mA) in the first boundary. Similarly, the measured block degradation data 412 may have a value of 10.5 milliamperes (mA) in the second boundary (i.e., (14+14+14+0)/4=10.5 milliamperes (mA)).

As described with reference to FIG. 4A, the measured block degradation data 412 may be more similar to (e.g., may be closer to) the real degradation data 411 than the predicted pixel degradation data 413; however, the measured block degradation data 412 may have a difference with the real degradation data 412 in the first boundary and the second boundary in which the degradation information is rapidly changed. The predicted degradation data 413 may have a waveform that is similar to a waveform of the real degradation data 412 in all regions. Therefore, the display device 100 according to some example embodiments may recover (or restore) a spatial resolution of the measured block degradation data 412 using the predicted pixel degradation data 413. In this case, the display device 100 may obtain more accurate degradation information (i.e., the pixel degradation data 413).

Referring to FIG. 4B, the measured degradation data 422 and predicted block degradation data 424 are illustrated. The predicted block degradation data 424 may be calculated based on the predicted pixel degradation data 413 by the degradation predicting unit 310. That is, the degradation predicting unit 310 may calculate the predicted block degradation data 424 based on the predicted pixel degradation data 413 illustrated in FIG. 4A. The measured degradation data 422 may include a current value of a pixel block, which includes 4 pixels adjacent to each other. Therefore, the degradation predicting unit 310 may calculate the predicted block degradation data 424 by calculating an arithmetic mean of the predicted pixel degradation data (e.g., currents) of the pixels that are adjacent to each other.

In this case, the degradation calculator 170 may analyze a correlation between the measured block degradation data 422 and the predicted block degradation data 424. For example, the degradation calculator 170 may calculate a linear equation that represents a correlation between third measured block degradation data 432 and third predicted block degradation data 434.

The degradation calculator 170 may calculate pixel degradation data of the pixels (e.g., the four pixels) using the linear equation and the predicted pixel degradation data of the pixels included in a pixel block.

Referring to FIG. 4C, the measured degradation data 422, the predicted block degradation data 424, the predicted pixel degradation data 413, and pixel degradation data 441 are illustrated. The predicted pixel degradation data 413 illustrated in FIG. 4C may be substantially the same as, or similar to, the predicted pixel degradation data 413 illustrated in FIG. 4A, and the measured degradation data 422 and the predicted block degradation data 424 illustrated in FIG. 4C may be, respectively, substantially the same as, or similar to, the measured degradation data 422 and the predicted block degradation data 424 illustrated in FIG. 4B.

The pixel degradation data 441 may be calculated based on the linear equation and the predicted pixel degradation data 413. The pixel degradation data 441 may include degradation data per unit pixel (i.e., on a pixel-by-pixel basis) instead of per unit pixel block (i.e., on block-by-block basis). Therefore, the display device 100 may correctly perform degradation compensation based on the pixel degradation data 441.

Figure 5A:
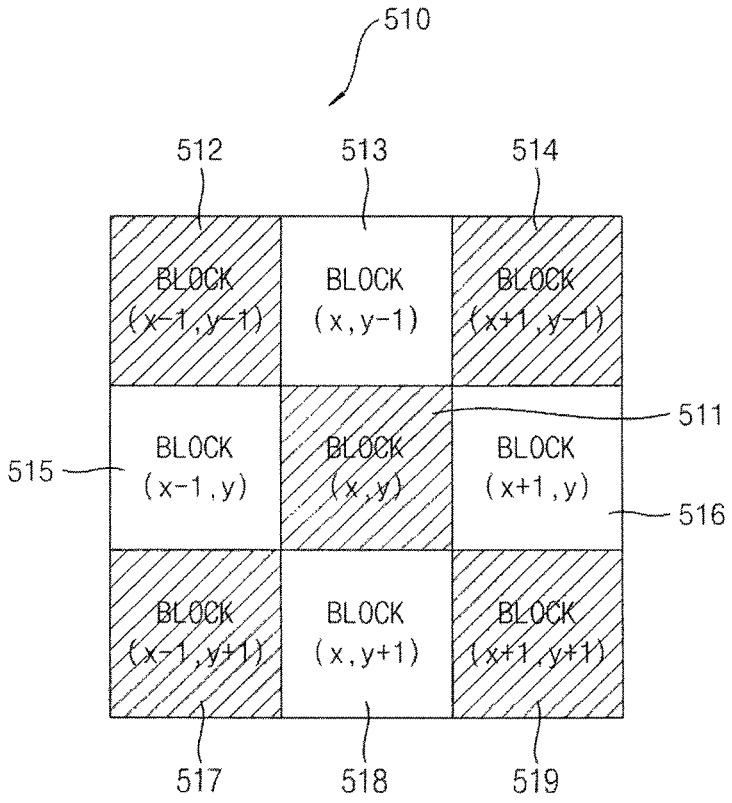
FIG. 5A is a diagram illustrating an example of a display panel included in the display device of FIG. 1.

FIG. 5A is a diagram illustrating an example of a display panel included in the display device of FIG. 1. FIG. 5B is a diagram illustrating an example in which pixel degradation data is calculated by the degradation calculator of FIG. 3.

Referring to FIGS. 1 and 5A, the display panel 510 may include 9 pixel blocks 511 through 519. Each of the pixel blocks 511 through 519 may include M×N pixels 111.

As described with reference to FIG. 3, the degradation calculator 170 may calculate predicted block degradation data Isp_B and measured block degradation data Ibs_B of each of the pixel blocks 511 through 519. For example, a first pixel block 511, which is at coordinates (x, y), may include first predicted block degradation data and first measured block degradation data. For example, second through ninth pixel blocks 512 through 519, which are adjacent to the first pixel block 511, may include second through ninth predicted block degradation data and second through ninth measured block degradation data, respectively.

While FIG. 5A illustrates the display panel 510 as including the 9 pixel blocks 511 through 519, the display panel 510 is not limited thereto. For example, the display panel 510 may include m×n pixel blocks, where each of m and n is a positive integer. Here, the display device 100 may analyze a correlation between predicted block degradation data Isp_B and measured block degradation data Ibs_B based on m×n predicted block degradation data and m×n measured block degradation data that are included in the m×n pixel blocks.

Figure 5B:
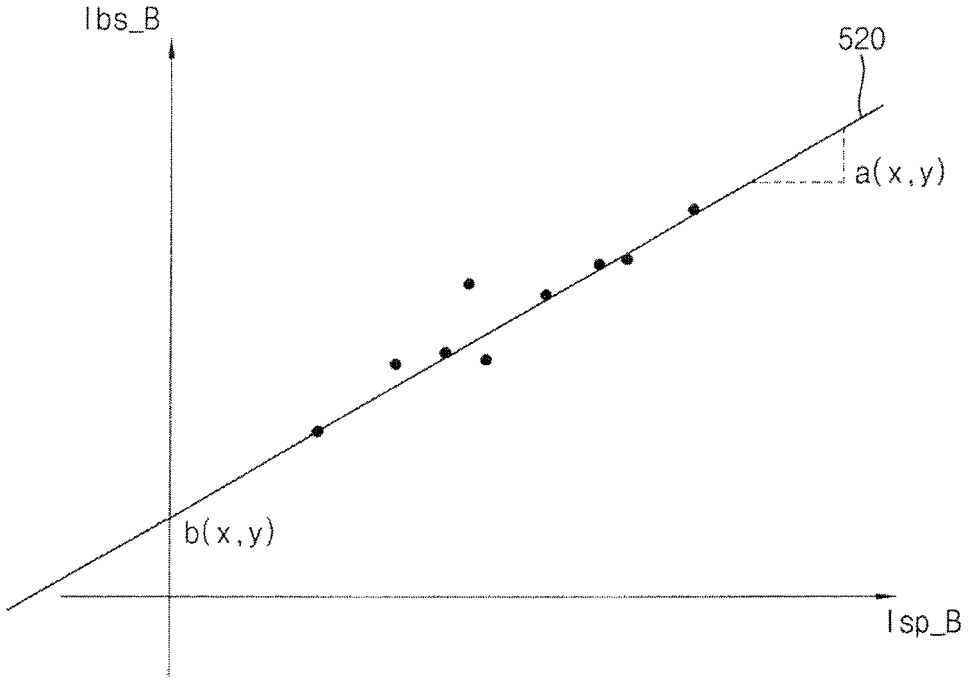
FIG. 5B is a diagram illustrating an example in which pixel degradation data is calculated by the degradation calculator of FIG. 3.

Referring to FIGS. 3 and 5B, the predicted block degradation data Isp_B and the measured block degradation data Ibs_B of the pixel blocks 511 through 519 illustrated in FIG. 5A may be illustrated in a two-dimensional plane. Here, a horizontal axis of the two-dimensional plane represents the predicted block degradation data Isp_B, and a vertical axis of the two-dimensional plane represents the measured block degradation data Ibs_B.

In some example embodiments, the pixel degradation calculating unit 330 may obtain a linear equation of data distribution that represents a correlation between the predicted block degradation data Isp_B and the measured block degradation data Ibs_B. The pixel degradation calculating unit 330 may obtain a linear equation that connects (i.e., relates) data of the pixel blocks 511 through 519. For example, the pixel degradation calculating unit 330 may obtain a first linear equation with a linear gradient, which is substantially the same as, or similar to, a form of the data distribution of the pixel blocks 511 through 519. As illustrated in FIG. 5B, the pixel degradation calculating unit 330 may calculate a first linear equation for a first straight line 520.

In an example embodiment, the pixel degradation calculating unit 330 may calculate a first coefficient and a first constant that satisfy Equation 1 below, where the first coefficient and the first constant may be a coefficient and a constant of the first linear equation.

$$\min \Sigma_i \Sigma_j (\Delta Ibs_B(x+i,y+j) - a^* \Delta Isp_B(x+i,y+j) - b)^2, \quad \text{[Equation 1]}$$

where ΔIbs_B(x, y) denotes the measured block degradation data having location information of (i.e., pertaining to) coordinates (x, y), ΔIsp_B(x, y) denotes the predicted block degradation data having location information of the coordinates (x, y), i denotes an integer, j denotes an integer, a denotes the first coefficient, and b denotes the first constant.

For example, to calculate a first linear equation of the first pixel block illustrated in FIG. 5A, measured block degradation data and first predicted block degradation data of the first pixel block 511, and measured block degradation data and predicted block degradation data of the second through ninth pixel blocks 512 through 519 that are adjacent to the first pixel block 511 may be used. When it is assumed that pixel blocks used in Equation 1 are defined as a reference block, the reference block may include the first pixel block 511. For example, the pixel block may include only the first pixel block 511. For example, the reference block may include the first pixel block 511 and one pixel block that is adjacent to the first pixel block 511 (e.g., a second pixel block 512, a third pixel block 513, a fourth pixel block 514, etc.). For example, the reference block may include at least two pixel blocks that are adjacent to the first pixel block 511 (e.g., at least two pixel blocks selected among the second through ninth pixel blocks 512 through 519).

The pixel degradation calculating unit 330 may calculate pixel degradation data Ibs_P based on predicted pixel degradation data Isp_P, the first coefficient, and the first constant.

In an example embodiment, the pixel degradation calculating unit 330 may calculate the pixel degradation data Ibs_P based on Equation 2 below.

$$\Delta Ibs_P(x,y)=a*\Delta Isp_P(x,y)+b, \quad \text{[Equation 2]}$$

where ΔIbs_P(x, y) denotes the pixel degradation data of a pixel having location information of coordinates (x, y), ΔIsp_P(x, y) denotes the predicted pixel degradation data of the pixel having location information of the coordinates (x, y), a denotes the first coefficient, and b denotes the first constant.

For example with reference to FIG. 4C, predicted pixel degradation data of a 195th pixel may be calculated by the degradation predicting unit 310, and the first coefficient a and the first constant b may be calculated by the pixel degradation calculating unit 330. Therefore, the pixel degradation calculating unit 330 may calculate pixel degradation data of the 195th pixel by applying values to Equation 2, where the values are calculated as predicted pixel degradation data Isp_P, the first coefficient a, and the first constant b.

The pixel degradation calculating unit 330 calculates the first linear equation based on the data distribution of FIG. 5B. However, the operation of the pixel degradation calculating unit 330 is not limited thereto.

For example, the pixel degradation calculating unit 330 may calculate n-dimensional linear equation based on the data distribution of FIG. 5B. As the order of the linear equation is higher, the correlation between the predicted block degradation data Isp_B and the measured block degradation data Ibs_B may be more accurate.

In an example embodiment, the pixel degradation calculating unit 330 may calculate coefficients and a first constant that satisfy Equation 3 below.

$$\min \Sigma_i \Sigma_j [\Delta Ibs_B(x+i,y+j)-b-\Sigma_k(a_k*(\Delta Isp_B(x+i,y+j))^k)]^2, \quad \text{[Equation 3]}$$

where ΔIbs_B(x, y) denotes the measured block degradation data having location information of coordinates (x, y), ΔIsp_B(x, y) denotes the predicted block degradation data having location information of the coordinates (x, y), i denotes an integer, j denotes an integer, k denotes a positive integer, a_k denotes a (k)th coefficient, and b denotes the first constant.

That is, the pixel degradation calculating unit 330 may calculate n-dimensional linear equation using n pixel blocks.

In an example embodiment, the pixel degradation calculating unit 330 may calculate the pixel degradation data Ibs_P based on Equation 4 below.

$$\Delta Ibs_P(x,y)=b+\Sigma_k(a_k*\Delta Isp_P(x,y)^k), \quad \text{[Equation 4]}$$

where ΔIbs_P(x, y) denotes the pixel degradation data of a pixel having location information of coordinates (x, y), ΔIsp_P(x, y) denotes the predicted pixel degradation data of the pixel having location information of the coordinates (x, y), a_k denotes the (k)th coefficient, and b denotes the first constant.

As described with reference to Equation 2, the pixel degradation calculating unit 330 may calculate the pixel degradation data (or a real degradation data) of the 195th pixel by applying values in Equation 4, where the values are calculated as the predicted pixel degradation data Isp_P, a (k)th coefficient a_k through the first constant b.

Figure 6:
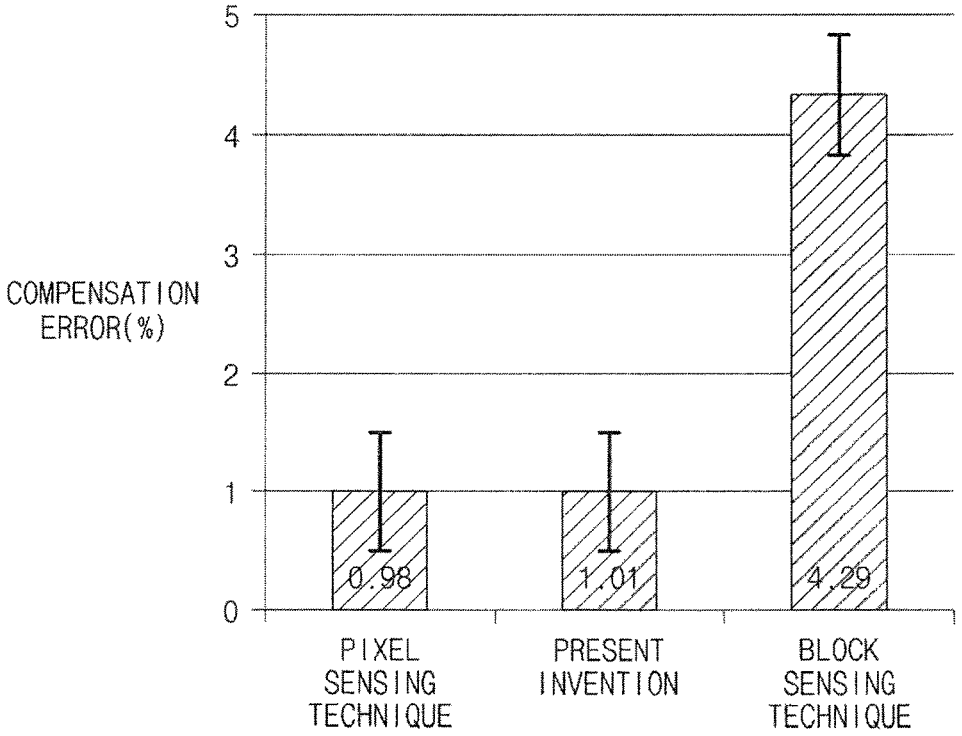
FIG. 6 is a diagram illustrating an example of an accuracy of pixel degradation data generated by the degradation calculator of FIG. 3.

FIG. 6 is a diagram illustrating an example of an accuracy of pixel degradation data generated by the degradation calculator of FIG. 3.

Referring to FIG. 6, a result of degradation compensation by a display device that employs a pixel sensing technique, a result of degradation compensation by a display device that employs a block sensing technique, and a result of degradation compensation by the display device 100 according to some example embodiments are illustrated.

The display device employing the pixel sensing technique may measure pixel degradation information of each of the pixels, and may compensate degradation of each of the pixels 111 based on measured pixel degradation information. The pixel sensing technique yields a low value of signal-to-noise ratio (SNR) for the degradation information in a low-gray level region. However, the result of degradation compensation illustrated in FIG. 6 does not consider the effect of noise. In this case, the display device employing the pixel sensing technique may have a compensation error of 0.98 percent (%) (i.e., a ratio of real degradation amount to a degradation compensation amount, or an error ratio of real pixel degradation data to calculated pixel degradation data).

The display device employing the block sensing technique may compensate degradation of each of pixels 111 by using the predicted block degradation data Ibs_B of the pixel block described with reference to the block degradation calculating unit 320 of FIG. 3. In this case, the display device employing the block sensing technique may have a compensation error of 4.29 percent (%).

The display device 100 according to some example embodiments may have a compensation error of 1.01 percent (%). Because the display device 100 may restore a spatial resolution of sensing data of a pixel block based on accumulated input data that is generated by accumulating input data provided to each of the pixels 111, the display device 100 may improve (e.g., increase) an accuracy of the sensing data and the spatial resolution of the sensing data. Therefore, the display device 100 may have a compensation error, which is substantially the same as, or similar to, a compensation error of the pixel sensing technique (i.e., the pixel sensing technique not considering an effect of noise), by compensating degradation based on the sensing data of which spatial resolution is improved (e.g., increased).

Figure 7:
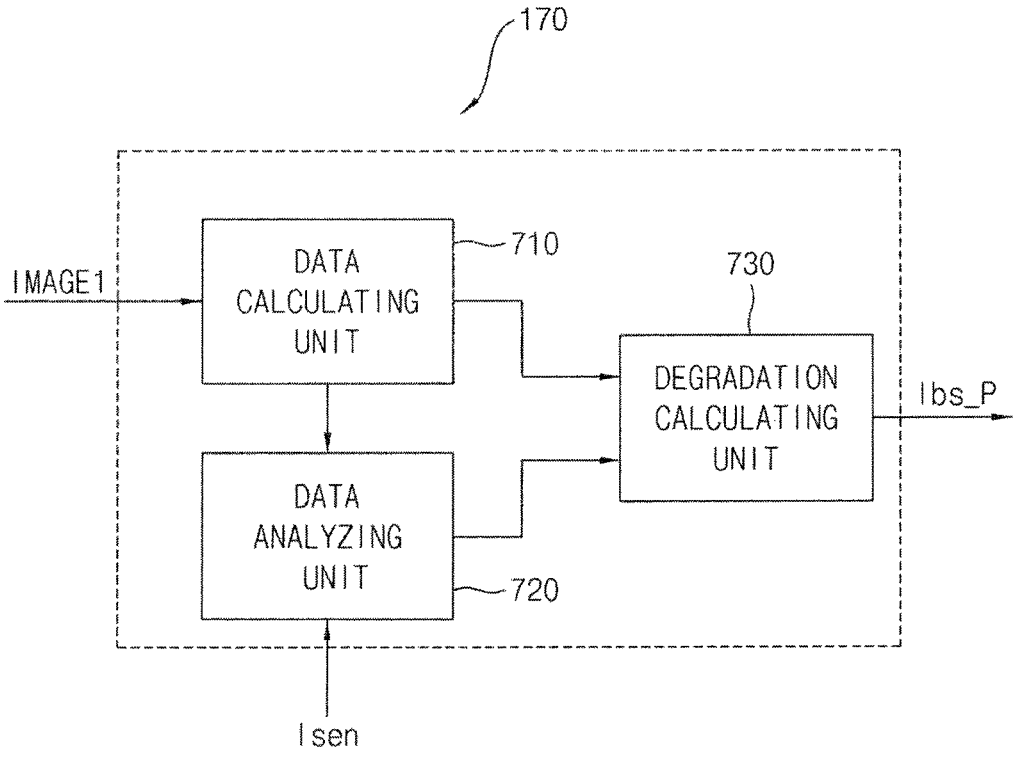
FIG. 7 is a diagram illustrating an example of the degradation calculator included in the display device of FIG. 1.

FIG. 7 is a diagram illustrating an example of the degradation calculator included in the display device of FIG. 1.

Referring to FIGS. 1 and 7, the degradation calculator 170 may calculate pixel degradation information of each of the pixels 111 based on the accumulate input data of each of the pixels 111 and degradation information of the pixel block, and may calculate pixel degradation data Ibs_P of each of the pixels 111 based on calculated pixel degradation information. That is, the degradation calculator 170 may restore a spatial resolution (or a spatial accuracy) of the degradation information (i.e., the degradation information of the pixel block) per unit pixel based on the accumulated input data of each of the pixels 111, and may calculate the pixel degradation data Ibs_p based on the degradation information for each pixel (i.e., pixel degradation information).

The degradation calculator 170 may include a data calculating unit (e.g., a data calculator) 710, a data analyzing unit (e.g., a data analyzer) 720, and a degradation calculating unit (e.g., a degradation calculator) 730.

The data calculating unit 710 may accumulate input data provided to each of the pixels 111, and may calculate average accumulated input data of a pixel block based on the accumulated input data. A process of calculating the accumulated input data by the data calculating unit 710 may be substantially the same as, or similar to, a process of calculating the accumulated input data by the degradation predicting unit 310 described with reference to FIG. 3. The data calculating unit 710 may calculate the average accumulated input data of the pixel block by calculating an arithmetic mean of the accumulated input data.

The data calculating unit 710 calculates the average accumulated input data of the pixel block based on the accumulated input data of each of the pixels 111. However, operation of the data calculating unit 710 is not limited thereto. For example, the data calculating unit 710 may calculate an arithmetic mean of input data (i.e., input data included in a certain pixel block) corresponding to a certain pixel block for each frame, and may calculate the average accumulated input data of the pixel block by accumulating the arithmetic mean of the input data for each frame.

The data analyzing unit 720 may analyze a second correlation between the degradation information and the average accumulated input data.

The data analyzing unit 720 may analyze the second correlation between the degradation information and the average accumulated input data by using Equation 1 (or Equation 3) described with reference to FIGS. 5A and 5B. That is, the data analyzing unit 720 may obtain a linear equation (e.g., Equation 2 or Equation 4) based on the degradation data (i.e., the degradation data of the pixel block) and the average accumulated input data (i.e., the average accumulated input data of the pixel block) instead of the measured block degradation data Ibs_B and the predicted block degradation data Isp_B.

The degradation calculating unit 730 may calculate the pixel degradation information of each of the pixels 111 based on the second correlation and the accumulated input data. That is, the degradation calculating unit 730 may calculate the pixel degradation information of each of the pixels 111 by applying the accumulated input data of each of the pixels 111 with the linear equation (e.g., the Equation 2, the Equation 4), which is derived by the data analyzing unit 720.

As described above, the degradation calculator 170 of FIG. 7 may recover the spatial resolution (or an spatial accuracy) of the degradation information (e.g., sensing data of the pixel block) per unit pixel based on the accumulated data of each of the pixels 111, and may calculate the pixel degradation data Ibs_P based on the degradation information (i.e., the pixel degradation information) of each pixel.

Figure 8:
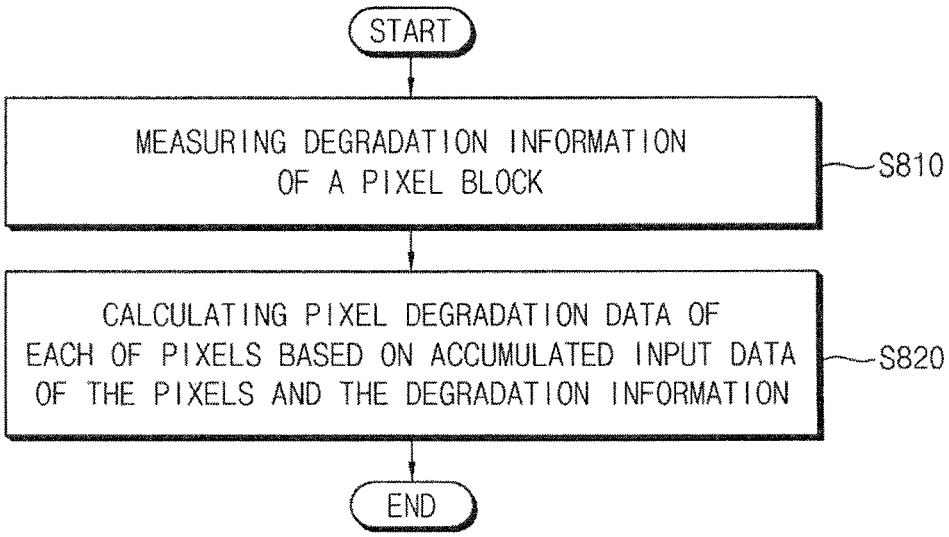
FIG. 8 is a flow diagram illustrating a method of driving a display device according to some example embodiments of the present inventive concept.

FIG. 8 is a flow diagram illustrating a method of driving a display device according to some example embodiments of the present inventive concept.

Referring to FIGS. 1 and 8, the method of FIG. 8 may drive the display device 100 of FIG. 1, which includes a pixel block 112 and pixels 111.

The method of FIG. 8 may measure degradation information of the pixel block 112 (S810). For example, the method of FIG. 8 may provide a reference data signal (e.g., a reference voltage) to the pixels 111, and may measure a current that is returned from the pixel block 112 in response to the reference data signal. The method of FIG. 8 may obtain the degradation information as a measured current.

The method of FIG. 8 may generate accumulated input data of each of the pixels 111 by accumulating input data that is provided to each of the pixels 111 during a certain timeframe. For example, the method of FIG. 8 may accumulate the input data provided to each of the pixels 111 within an accumulation period, and may store the accumulated input data in a memory device. The method of FIG. 8 may read the accumulated input data stored in the memory device, accumulate input data of current frame to the accumulated input data that is read, and may store the accumulated input data, which is added the input data of current frame, in the memory device.

The method of FIG. 8 may calculate pixel degradation data Ibs_P of each of the pixels 111 based on the accumulated input data of each of the pixels 111 and the degradation information (i.e., the degradation information of the pixel block 112) (S820). A process of calculating the pixel degradation data Ibs_P will be described in more detail with reference to FIGS. 9 and 10.

Figure 9:
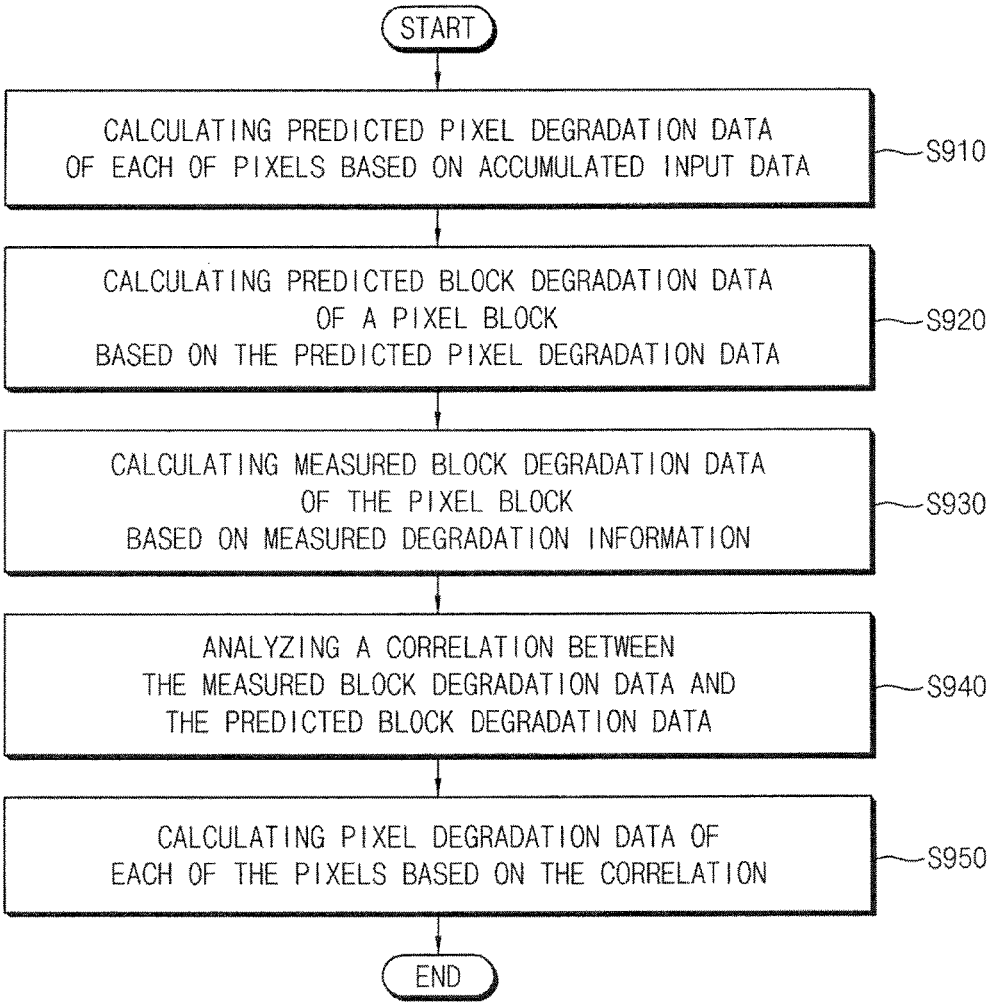
FIG. 9 is a flow diagram illustrating an example in which pixel degradation data is calculated by the method of FIG. 8.

FIG. 9 is a flow diagram illustrating an example in which pixel degradation data is calculated by the method of FIG. 8.

Referring to FIGS. 1, 8, and 9, the method of FIG. 9 may be performed by the display device 100 of FIG. 1. The method of FIG. 9 may calculate predicted pixel degradation data Isp_P of each of the pixels 111 based on the accumulated input data (S910). For example, the method of FIG. 9 may calculate the predicted pixel degradation data Isp_P using a stress profile that represents a pixel degradation rate with respect to the accumulated input data.

The method of FIG. 9 may calculate predicted block degradation data Isp_B of the pixel block 112 based on the predicted pixel degradation data Isp_B (S920). For example, the method of FIG. 9 may calculate the predicted block degradation data Isp_B of the pixel block 112 by calculating an arithmetic mean of the predicted pixel degradation data Isp_P of pixels included in the pixel block 112.

The method of FIG. 9 may calculate measured block degradation data Ibs_B of the pixel block 112 based on measured degradation information (i.e., the degradation information of the pixel block 112) (S930). For example, the method of FIG. 9 may determine the measured block degradation data Ibs_B as a current that is measured at the pixel block 112.

The method of FIG. 9 may analyze a correlation between the measured block degradation data Ibs_B and the predicted block degradation data Isp_B (S940). As described with reference to FIGS. 5A and 5B, the method of FIG. 9 may obtain a linear equation of a data distribution that represents a correlation between the predicted block degradation data Isp_B and the measured block degradation data Ibs_B. The method of FIG. 9 may calculate pixel degradation data Ibs_P of each of the pixels based on the correlation that is analyzed (S950).

In an example embodiment, the method of FIG. 9 may calculate a first coefficient and a first constant that satisfy Equation 1 described above. In addition, the method of FIG. 9 may calculate the pixel degradation data Ibs_P based on the predicted pixel degradation data Isp_P, the first coefficient, and the first constant.

As described above, the method of FIG. 9 may recover a spatial resolution of sensing data of the pixel block based on the accumulated input data, which is the accumulated input data provided to each of the pixels 111. Therefore, the method of FIG. 9 may improve (e.g., increase) an accuracy of the sensing data and the spatial resolution of the sensing data.

Figure 10:
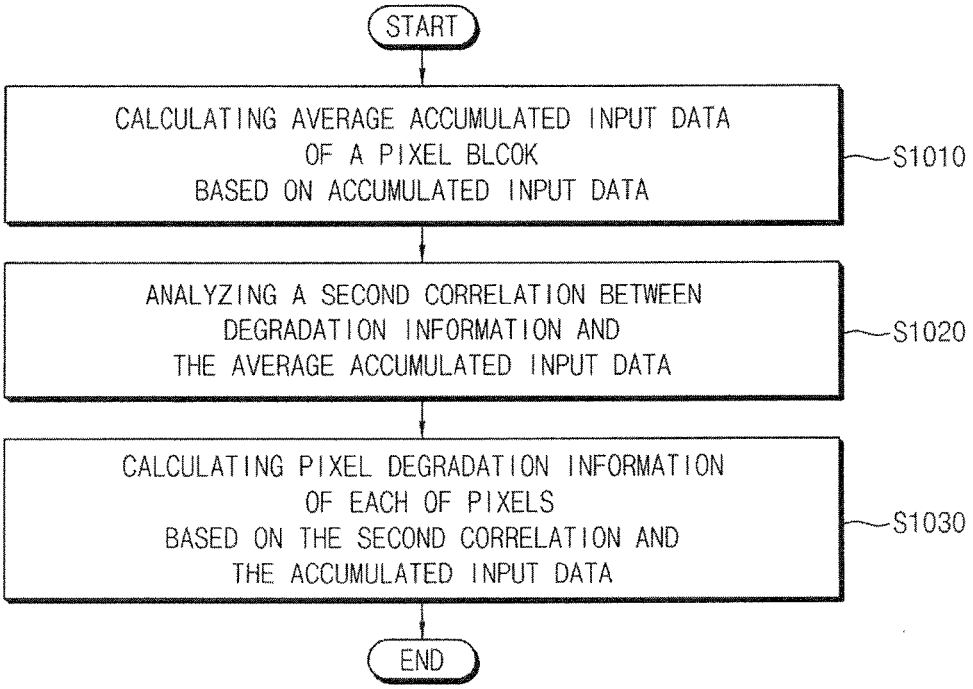
FIG. 10 is a flow diagram illustrating another example in which pixel degradation data is calculated by the method of FIG. 8.

FIG. 10 is a flow diagram illustrating another example in which pixel degradation data is calculated by the method of FIG. 8.

Referring to FIGS. 1, 8, and 10, the method of FIG. 10 may calculate average accumulated input data of the pixel block 112 based on the accumulated input data (S1010). For example, the method of FIG. 10 may calculate the average accumulated input data of the pixel block 112 by calculating an arithmetic mean of the accumulated input data.

The method of FIG. 10 may analyze a second correlation between the degradation information (i.e., the degradation information of the pixel block 112) and the average accumulated input data (S1020). As described with reference to FIG. 7, the method of FIG. 10 may analyze the second correlation between the degradation information and the average accumulated input data using the Equation 1 (or Equation 3).

The method of FIG. 10 may calculate pixel degradation information of each of the pixels 111 based on the second correlation and the accumulated input data (i.e., the accumulated input data of each of the pixels 111) (S1030). As described with reference to FIG. 7, the method of FIG. 10 may obtain a linear equation (e.g., Equation 2 or Equation 4) based on the degradation information (i.e., the degradation information of the pixel block 112) and the average accumulated input data (i.e., the average accumulated input data of the pixel block 112), instead of the measured block degradation data Ibs_B and the predicted block degradation data Isp_B.

As described above, the method of FIG. 10 may recover a spatial resolution of sensing data of the degradation information (i.e., sensing data of the pixel block) per unit pixel based on the accumulated input data of each of the pixels 111, and may calculate the pixel degradation data Ibs_P based on the degradation information (e.g., pixel degradation information) for each pixel.

The present inventive concept may be applied to any display device. For example, the present inventive concept may be applied to a television, a computer monitor, a laptop, a digital camera, a cellular phone, a smart phone, a personal digital assistant (PDA), a portable multimedia player (PMP), an MP3 player, a navigation system, a video phone, etc.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Further, the use of "may" when describing embodiments of the inventive concept refers to "one or more embodiments of the inventive concept."

It will be understood that when an element or layer is referred to as being "on", "connected to", "coupled to", or "adjacent" another element or layer, it can be directly on, connected to, coupled to, or adjacent the other element or layer, or one or more intervening elements or layers may be present. When an element or layer is referred to as being "directly on," "directly connected to", "directly coupled to", or "immediately adjacent" another element or layer, there are no intervening elements or layers present.

As used herein, the term "substantially," "about," and similar terms are used as terms of approximation and not as terms of degree, and are intended to account for the inherent variations in measured or calculated values that would be recognized by those of ordinary skill in the art.

As used herein, the terms "use," "using," and "used" may be considered synonymous with the terms "utilize," "utilizing," and "utilized," respectively.

Also, any numerical range recited herein is intended to include all sub-ranges of the same numerical precision subsumed within the recited range. For example, a range of "1.0 to 10.0" is intended to include all subranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein and any minimum numerical limitation recited in this specification is intended to include all higher numerical limitations subsumed therein. Accordingly, Applicant reserves the right to amend this specification, including the claims, to expressly recite any sub-range subsumed within the ranges expressly recited herein. All such ranges are intended to be inherently described in this specification such that amending to expressly recite any such subranges would comply with the requirements of 35 U.S.C. § 112, first paragraph, and 35 U.S.C. § 132(a).

The display device and/or any other relevant devices or components, such as the timing controller 120, the scan driver 130, the data driver 140, the power supplier 150, the degradation sensor 160, and the degradation calculator 170, according to embodiments of the present invention described herein may be implemented utilizing any suitable hardware, firmware (e.g. an application-specific integrated circuit), software, or a suitable combination of software, firmware, and hardware. For example, the various components of the display device may be formed on one integrated circuit (IC) chip or on separate IC chips. Further, the various components of the display device may be implemented on a flexible printed circuit film, a tape carrier package (TCP), a printed circuit board (PCB), or formed on a same substrate. Further, the various components of the display device may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the example embodiments of the present invention.

The foregoing is illustrative of example embodiments, and is not to be construed as limiting thereof. Although a few example embodiments have been described, those skilled in the art will readily appreciate that many modifications are possible in the example embodiments without materially departing from the novel teachings and advantages of example embodiments. Accordingly, all such modifications are intended to be included within the scope of example embodiments as defined by the claims and their equivalents. In the claims, means-plus-function clauses are intended to cover the structures described herein as performing the recited function and also equivalent structures. Therefore, it is to be understood that the foregoing is illustrative of example embodiments and is not to be construed as limited to the specific embodiments disclosed, and that suitable modifications to the disclosed example embodiments, as well as other example embodiments, are intended to be included within the scope of the appended claims. The inventive concept is defined by the following claims and their equivalents.

What is claimed is:

1. A display device comprising:

a display panel comprising a pixel block that comprises pixels;

a degradation sensor configured to measure degradation information of the pixel block; and a degradation calculator configured to accumulate input data provided to each of the pixels and to calculate pixel degradation data of each of the pixels based on the accumulated input data and the measured degradation information, wherein the degradation calculator comprises:

a degradation predictor configured to accumulate the input data provided to each of the pixels, to calculate predicted pixel degradation data of each of the pixels based on the accumulated input data, and to calculate predicted block degradation data of the pixel block based on the predicted pixel degradation data;

a block degradation calculator configured to calculate measured block degradation data of the pixel block based on the measured degradation information; and a pixel degradation calculator configured to calculate an equation of data distribution representing a correlation between the measured block degradation data and the predicted block degradation data and to calculate the pixel degradation data of each of the pixels based on the equation.

2. The display device of claim 1, wherein the degradation sensor is further configured to measure a current returned from the pixel block in response to a reference data signal provided to the pixels.

3. The display device of claim 1, wherein the degradation calculator is further configured to calculate predicted pixel degradation data of each of the pixels based on the accumulated input data, to calculate measured block degradation data of the pixel block based on the measured degradation information, and to calculate the pixel degradation data of each of the pixels based on the predicted pixel degradation data and the measured block degradation data.

4. The display device of claim 1, wherein the degradation predictor is configured to calculate the predicted pixel degradation data using a stress profile that represents a relation between the accumulated input data and a pixel degradation rate of each of the pixels.

5. The display device of claim 1, wherein the degradation predictor is configured to calculate the predicted block degradation data using an arithmetic mean of the predicted pixel degradation data.

6. The display device of claim 1, wherein the pixel degradation calculator is further configured to derive a linear equation corresponding to a data distribution map that represents the correlation.

7. The display device of claim 1, wherein the pixel degradation calculator is further configured to calculate a first coefficient and a first constant that satisfy Equation 1 below:

$$\min \Sigma_i\Sigma_j(\Delta Ibs_B(x+i,y+j)-a*\Delta Isp_B(x+i,y+j)-b)^2, \quad \text{[Equation 1]}$$

where ΔIbs_B(x, y) denotes the measured block degradation data pertaining to coordinates (x, y), ΔIsp_B(x, y) denotes the predicted block degradation data pertaining to the coordinates (x, y), i denotes an integer, j denotes an integer, a denotes the first coefficient, and b denotes the first constant.

8. The display device of claim 7, wherein the pixel degradation calculator is configured to calculate the pixel degradation data based on the predicted pixel degradation data, the first coefficient, and the first constant.

9. The display device of claim 7, wherein the pixel degradation calculator is configured to calculate the pixel degradation data based on Equation 2 below:

$$\Delta Ibs_P(x,y)=a*\Delta Isp_P(x,y)+b, \quad \text{[Equation 2]}$$

where ΔIbs_P(x, y) denotes the pixel degradation data of a pixel pertaining to the coordinates (x, y), ΔIsp_P(x, y) denotes the predicted pixel degradation data of the pixel pertaining to the coordinates (x, y), a denotes the first coefficient, and b denotes the first constant.

10. The display device of claim 1, wherein the pixel degradation calculator is further configured to calculate coefficients and a first constant that satisfy Equation 3 below:

$$\min \Sigma_i\Sigma_j[\Delta Ibs_B(x+i,y+j)-b-\Sigma_k(a_k*(\Delta Isp_B(x+i,y+j))^k]^2, \quad \text{[Equation 3]}$$

where ΔIbs_B(x, y) denotes the measured block degradation data pertaining to coordinates (x, y), ΔIsp_B (x, y) denotes the predicted block degradation data pertaining to the coordinates (x, y), i denotes an integer, j denotes an integer, k denotes a positive integer, a_k denotes a (k)th coefficient, and b denotes the first constant.

11. The display device of claim 10, wherein the pixel degradation calculator is configured to calculate the pixel degradation data based on Equation 4 below:

$$\Delta Ibs_P(x,y)=b+\Sigma_k(a_k*\Delta Isp_P(x,y)^k), \quad \text{[Equation 4]}$$

where ΔIbs_P(x, y) denotes the pixel degradation data of a pixel pertaining to the coordinates (x, y), ΔIsp_P(x, y) denotes the predicted pixel degradation data of the pixel pertaining to the coordinates (x, y), a_k denotes the (k)th coefficient, and b denotes the first constant.

12. The display device of claim 1, further comprising:

a timing controller configured to compensate second input data based on the pixel degradation data.

13. The display device of claim 1, wherein the degradation calculator is configured to calculate pixel degradation information of each of the pixels based on the accumulated input data and the pixel degradation data, and to calculate the pixel degradation data of each of the pixels based on the pixel degradation information.

14. The display device of claim 13, wherein the degradation calculator comprises:

a data calculator configured to calculate average accumulated input data of the pixel block based on the accumulated input data;

a data analyzer configured to analyze a second correlation between the measured degradation information and the average accumulated input data; and a degradation calculator configured to calculate the pixel degradation information of each of the pixels based on the second correlation and the accumulated input data.

15. A method of driving a display device comprising a pixel block that comprises pixels, the method comprising:

measuring degradation information of the pixel block; and calculating pixel degradation data based on accumulated input data of each of the pixels, the accumulated input data being generated by accumulating input data provided to respective one of the pixels and the measured degradation information, wherein calculating the pixel degradation data of each of the pixels comprises:

calculating predicted pixel degradation data of each of the pixels based on the accumulated input data;

calculating predicted block degradation data of the pixel block based on the predicted pixel degradation data;

calculating measured block degradation data of the pixel block based on the measured degradation information;

calculating an equation of data distribution representing a correlation between the measured block degradation data and the predicted block degradation data; and calculating the pixel degradation data of each of the pixels based on the equation.

16. The method of claim 15, wherein analyzing the correlation comprises:

calculating a first coefficient and a first constant that satisfy Equation 1 below:

$$\min \Sigma_i \Sigma_j (\Delta Ibs_B(x+i,y+j) - a*\Delta Isp_B(x+i,y+j) - b)^2, \quad \text{[Equation 1]}$$

where ΔIbs_B(x, y) denotes the measured block degradation data pertaining to coordinates (x, y), ΔIsp_B(x, y) denotes the predicted block degradation data pertaining to the coordinates (x, y), i denotes an integer, j denotes an integer, a denotes the first coefficient, and b denotes the first constant.

17. The method of claim 16, wherein calculating the pixel degradation data comprises:

calculating the pixel degradation data based on the predicted pixel degradation data, the first coefficient, and the first constant.

18. The method of claim 15, wherein calculating the pixel degradation data comprises:

calculating average accumulated input data of the pixel block based on the accumulated input data;

analyzing a second correlation between the measured degradation information and the average accumulated input data; and calculating pixel degradation information of each of the pixels based on the second correlation and the accumulated input data.

* * * * *